United States Patent [19]

Homs

[11] 4,083,109

[45] Apr. 11, 1978

[54] CENTER PUNCH GUIDE AND PUNCHES

[76] Inventor: Douglas M. Homs, Hillsborough, Calif.

[21] Appl. No.: 765,593

[22] Filed: Feb. 4, 1977

[51] Int. Cl.[2] ..... B26F 1/32

[52] U.S. Cl. ..... 30/368; 33/191

[58] Field of Search ..... 30/358, 366, 367, 368, 30/290; 33/189, 191; 408/72, 72 B; 269/1

[56] References Cited

U.S. PATENT DOCUMENTS

| | | | |
|---|---|---|---|
| 1,449,136 | 3/1923 | Yates | 30/367 |
| 1,508,175 | 9/1924 | Fontaine | 33/191 |
| 1,904,242 | 4/1933 | Kieckheafer | 33/191 |
| 2,809,439 | 10/1957 | Ringgold | 33/191 |
| 3,482,324 | 12/1969 | Samhat | 30/368 |

*Primary Examiner*—Jimmy C. Peters
*Attorney, Agent, or Firm*—Julian Caplan

[57] ABSTRACT

A guide having varying diameter holes over one of its surfaces, with each hole having a bottom partition, is provided to receive within the holes the ends of dowels, pins, rods, and the like, to be center held for punching or for sizing. Smaller holes aligned with the varying diameter holes are formed in the bottom partition and emerge from the opposite surface of the guide, the smaller holes being adapted to receive the center punch. The guide can also be positioned with the varying diameter holes facing upward, so that the punch can be inserted through both the larger and smaller holes for accurately aligning the punch to a desired point on a flat surface. Preferably, the varying diameter holes will be of a size to fit appropriate size shanks of drills, so that the punch guide can also be used as a drill holder. Also, a socket can be molded into the bottom of the guide for storing the punch. A first punch for use with the guide has points at both ends and a larger diameter shank therebetween. A removable cap can be placed over one point to provide a tapping surface so that the opposite point can be used for center punching. A second punch has a single point with a flat adjacent thereto for preventing breakdown of the corners when centering holes of lesser diameter than the punch.

4 Claims, 6 Drawing Figures

CENTER PUNCH GUIDE AND PUNCHES

This invention relates to a new and improved center punch guide and center punches for use therewith.

The present invention provides a punch guide having varying size holes formed in the upper surface for receiving appropriate size dowels, rods, shafts, pins etc., each of which will be referred to as a "dowel". Preferably, markings are placed in proximity to the holes indicating the sizes thereof. A partition is formed in the guide at the bottom of each hole and a smaller size hole is formed in the partition in axial alignment with the larger hole. Accordingly, the device can be used to accurately punch a center in a dowel. Ordinarily, it has been difficult to accurately locate the center of the dowel for drilling purposes without the use of instruments which are inconvenient to use. The present invention enables the user to insert the dowel in a particular hole which is of appropriate size for the size of the dowel, and then, by inserting a punch through the hole in the partition, to accurately center the punch relative to the center of the end of the dowel.

The hole in the partition is preferably of a size to accommodate the elongated shank of two types of center punches, hereinafter described. Thus the shank of the punch and its working end are accurately centered relative to the hole in the partition.

A preferred punch for use with the guide has points at both ends, each point having a flat adjacent it and a larger diameter, knurled shank therebetween. A knurled cap can be removably placed over either of the points. When the cap is tapped with a hammer the other point can be used for center punching. A second preferred punch has a single point with a flat adjacent to the point. The flat portion enables the punches to be used as transfer punches, for centering holes of lesser diameter than the punch without causing breakdown of the corners.

As another aspect of the invention, the holes formed in the upper surface of the guide can be used to receive different diameter drill shanks, to allow storage of several drills with ready access by the user. A socket can be molded into the bottom of the guide for receiving a punch for storage. Markings can be placed next to the holes to indicate the particular drill size to be stored in each hole.

The centers of the holes of the punch guide are intersected by lines scribed on the upper surface of the guide, so that the guide can be used to punch a hole in a sheet of material such as sheet metal, wood, composition board, etc., (hereinafter referred to as "metal plate"). By aligning these lines with lines scribed on the metal plate, an accurate alignment of the punch with the scribed lines may be achieved.

Other objects of the present invention will become apparent upon reading the following specification and referring to the accompanying drawings in which similar characters of reference represent corresponding parts in each of the several views.

Figure 1:
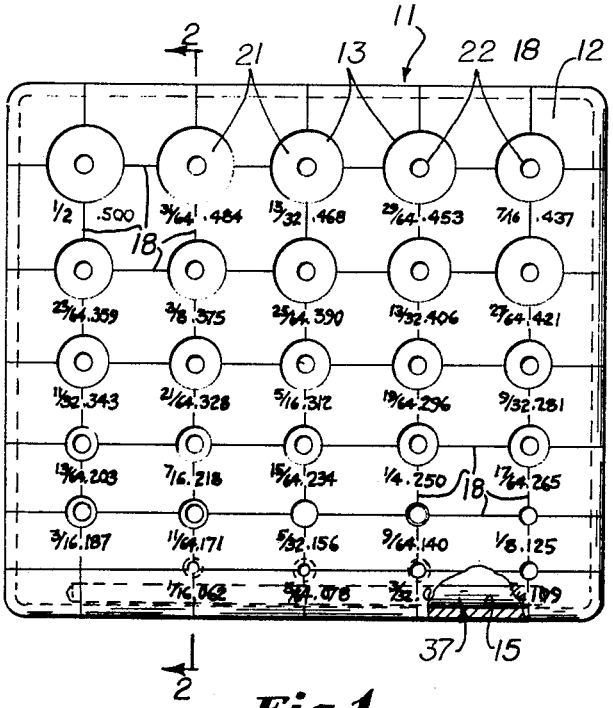
FIG. 1 is a plan view of the top of a holder in accordance with the present invention.

Center punch guide 11 may be of any convenient size and shape and may be formed of a variety of materials such as metal, plastic, etc. Recessed into the top surface 12 of guide 11 are holes 13. As here shown, the holes 13 are of different diameters to accommodate different size dowels, the end of which are inserted into the appropriate holes 13 so that they fit snugly for center punching or sizing. As shown in FIG. 1, indicia showing the sizes of the various dowels to be centered are preferably displayed adjacent the holes 13.

Closing off the top portion 12 of center punch guide 11 is a partition 21 which provides a seat for the ends of the dowels when they are inserted into the holes 13. In alignment with the center of each hole 13 is a small diameter hole 22 extending through the partition 21.

Preferably, the guide 11 is formed of a transparent plastic material and has lines 18 scribed on the under surface intersecting the centers of the holes 13. The lines 18 enable the guide to be used for accurately centering a hole on sheet metal or any other flat surface, as will be further discussed below.

The guide 11 is preferably molded of clear plastic in a rectangular shape approximately 3½ inches by 4 inches with a depth of about ¾ inches. The varying diameter holes 13 are arranged in a series of rows, with the holes varying from about ½ inch down to about 7/64 inch in size. Indicia showing the sizes of the holes may be raised or recessed or otherwise marked adjacent each of the holes. The smaller diameter holes 22 need only be of a size appropriate for receiving the center punches, and preferably are about ⅛ inch diameter.

Figure 2:
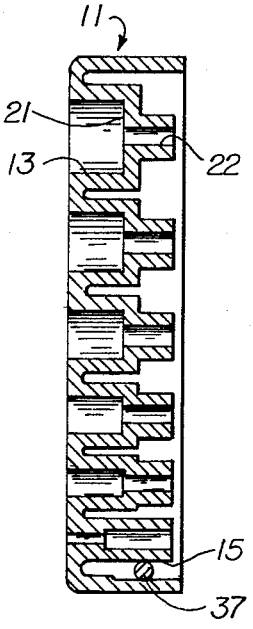
FIG. 2 is a sectional view taken substantially along the line 2—2 of FIG. 1.

When the guide is laid on a flat surface such as a table, the different diameter holes 13 can be used to accommodate different size drills, the shanks of which can be inserted into the appropriate holes so that they fit standing upright for ready access and removal as required. The indicia adjacent each hole can be used to find the appropriate hole for the various sizes of shank diameters, as will be further described below. As shown in FIGS. 1, 2, a socket 15 is molded into the bottom of the guide 11 for storage of a punch. A transfer punch, for example, can be easily snapped into place within socket 15, where it will be snugly retained until time for re-use.

Figure 3:
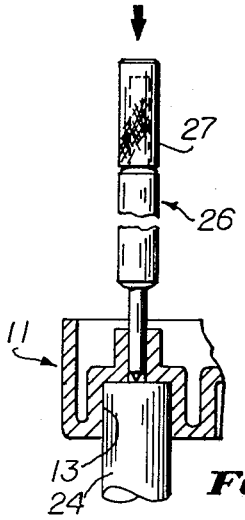
FIG. 3 is an elevational view partially broken away in section showing a guide and punch of this invention in use.

Use of the guide 11 to mark a center in a dowel 24 is illustrated in FIG. 3. The end of the dowel 24 is inserted into the appropriate diameter hole 13. Thus the dowel 24 is accurately centered relative to the appropriate hole 13. Thereupon, the shank of a punch 26 having a cap 27 is inserted through the appropriate hole 22 which is aligned with the hole 13 in which the dowel 24 is located. Tapping on the cap 27 with a hammer or the like in the direction of the arrow will punch a mark exactly at the center of the dowel 24.

Figure 4:
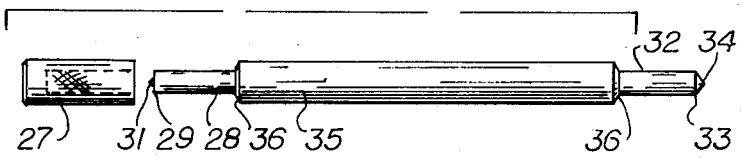
FIG. 4 is a plan view showing a centering punch and cap of this invention.
Figure 5:
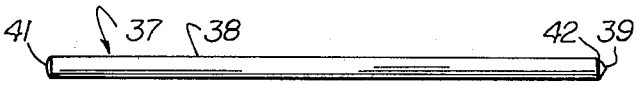
FIG. 5 is a plan view showing another centering punch of this invention.

A preferred centering punch, as shown in FIG. 4, has a first end portion 28 with a flat 29 and point 31 at one end of the punch, and a second end portion 32 with flat 33 and point 34 at the opposite end of the punch. Both end portions 28 and 32 have the same size as the guide holes 22 and are of sufficient length to permit either point to contact the end of dowel 24. Cap 27 is provided with a knurl so that it can be easily removed from and placed over either of the end portions 28, 32, to provide a tapping surface when the opposite point is used for center punching. Punch 26 has an enlarged shank 35, also provided with a knurl, and shoulders 36 for abutting the inside edges of the cap 27, for absorbing the force of the hammer used in the punching operation.

Another preferred punch 37 has an elongated shank 38 with point 39 at one end. The opposite end 41 is used at the tapping surface. Adjacent the point 39 is a flat 42 which protects the corners of the punch when it is used for a centering operation on a hole of lesser diameter than that of the punch itself. Conventional punches without such flat would tend to break down at the corners when so used. Punch 37, referred to as a transfer punch, has been found to be particularly useful for centering operations conducted on flat surfaces, as in sheet metal work.

Figure 6:
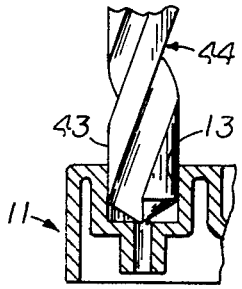
FIG. 6 is a view similar to FIG. 3 showing a drill shank inserted in a large hole of the guide.

As shown in FIG. 6, when the guide 11 is placed horizontally with the varying diameter holes 13 facing upward, the shank 43 of a drill 44 can be inserted into the appropriate hole 13 so that the drill 44 can be stored standing upright in the guide 11 for ready access and removal. Due to the large number of varying diameter holes 13, with size indicia marked adjacent each such hole, a variety of drill sizes can be accommodated for storage.

Although specific embodiments of the invention have been descirbed, it is clear that modifications of the invention can be made by those skilled in the art without departing from the spirit thereof, as set forth in the following claims.

I claim:

1. A center punch comprising an elongated uniform-diameter shank having shoulders and reduced-diameter pointed portions at either end, and a removable cap which can be placed over either of the reduced-diameter pointed portions with the inside edges of the cap abutting the shoulders, so that the cap can be used as a tapping surface when the opposite end of the punch is used for center punching, said cap having an external diameter equal to that of said shank and an internal diameter portion slightly greater than said reduced-diameter portions.

2. A center punch guide comprising a block, said block being formed with a series of first holes extending inward from a first face of said block, said first holes being arranged in a regular pattern of varying diameters, said block being formed with a plurality of partitions for closing off the bottom of each said first hole, each said partition being formed with a second hole extending inward from a second face of said block opposite said first face, each said second hole being axially aligned with one said first hole, each of said second holes being smaller than the particular first hole with which it is aligned, said first holes being dimensioned to hold a plurality of drills of different sizes, said second holes being dimensioned to receive the shank of a removable center punch.

3. A center punch guide according to claim 2 in which a surface of said guide is scribed by first and second lines intersecting at right angles at the centers of said holes.

4. A center punch guide according to claim 2 and a center punch detached from said holder having an elongated shank of a diameter equal to said second holes, said block being formed with a socket recessed into said second face to receive said shank for storage of said punch.

* * * * *